US011913308B2

(12) United States Patent
Groover et al.

(10) Patent No.: US 11,913,308 B2
(45) Date of Patent: Feb. 27, 2024

(54) METHOD AND APPARATUS FOR TESTING AND CONFIRMING A SUCCESSFUL DOWNLINK TO A ROTARY STEERABLE SYSTEM

(71) Applicant: Nabors Drilling Technologies USA, Inc., Houston, TX (US)

(72) Inventors: Austin Groover, Spring, TX (US); Drew Curran, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 492 days.

(21) Appl. No.: 17/235,324

(22) Filed: Apr. 20, 2021

(65) Prior Publication Data

US 2022/0333443 A1 Oct. 20, 2022

(51) Int. Cl.

| | |
|---|---|
| ***E21B 4/02*** | (2006.01) |
| ***E21B 7/06*** | (2006.01) |
| ***E21B 44/00*** | (2006.01) |
| ***F04B 47/02*** | (2006.01) |

(52) U.S. Cl.

CPC ..... *E21B 4/02* (2013.01); *E21B 7/068* (2013.01); *E21B 44/00* (2013.01); *F04B 47/02* (2013.01)

(58) Field of Classification Search

CPC . E21B 4/02; E21B 7/068; E21B 23/00; G05B 23/00

See application file for complete search history.

(56) References Cited

U.S. PATENT DOCUMENTS

2017/0218733 A1* 8/2017 Jain ..... E21B 44/00
2021/0065050 A1* 3/2021 Laing ..... E21B 44/00

* cited by examiner

*Primary Examiner* — Mark A Connolly
(74) *Attorney, Agent, or Firm* — Haynes and Boone, LLP

(57) ABSTRACT

A method that includes an electronic application identifying a downlink sequence for execution by a surface control system of a drilling rig, with the sequence including target output values of a mud pump system and/or a drive system. The method includes instructing the control system to operate in accordance with the sequence. The application receives measured output values of the mud pump system and/or the drive system and calculates differences between the target and measured output values. When the differences are within a level of tolerance, then the application identifies the control system as compliant; and when the differences are greater than the level of tolerance, then the application identifies the control system as non-compliant. The method also includes the application receiving data from a BHA of the drilling rig and determining, based on the data received, if a downlink to the BHA was successful.

20 Claims, 7 Drawing Sheets

METHOD AND APPARATUS FOR TESTING AND CONFIRMING A SUCCESSFUL DOWNLINK TO A ROTARY STEERABLE SYSTEM

FIELD OF THE DISCLOSURE

The disclosure herein relates to methods and apparatuses for testing the ability of a surface control system of a drilling rig to operate in accordance with a downlink sequence and also confirming a successful downlink to a rotary steerable system.

BACKGROUND

During a drilling operation, a driller sends instructions to a bottom hole assembly ("BHA") so that tool settings associated with the BHA are changed, which results in pointing the drilling bit in a certain direction. Often, the instructions are sent to the BHA—or downlinked—via a downlink sequence that requires the adjustment of control parameters over a set period of time.

Conventionally, when the driller wants to change the settings of a tool associated with the BHA, the driller controls the adjustment of the control parameters throughout the set period of time. This may include sending, via a drilling module of a surface control system, control signals to a drive control system and/or a mud pump control system. When the downlink sequence requires a control parameter to alternate between two values every few seconds, the driller may rely on a traditional stopwatch to determine when to alternate between the two values. In some instances, the driller relies on an automated program that alerts the driller when to alternate between the two values. If the driller misreads the stopwatch or misses an alert from the automated program, the control parameter may not be altered at the correct time and the instructions may fail to downlink to the downhole tool. Another cause of a failed downlink is a failure with the surface control system and/or controlled systems. For example, when the driller enters the correct controls at the appropriate times, the downlink may still fail because the mud pump system and/or the drive system do not provide the desired outputs. This may be a result of delays in the control system, faulty programming, miscommunication between systems, etc. When a downlink sequence fails to be executed correctly, the tool does not receive the instructions or receives incorrect instructions. This miscommunication can lead to increased tortuosity of the borehole, an increased departure of the BHA from a planned drilling path, increased equipment wear and/or damage, and lost drilling time.

Thus, an automated drilling system that ensures that the surface control system and/or controlled systems can provide desired outputs upon command, notifies a user of compliance or non-compliance of the surface control system and/or controlled system, and tracks the success or failure of downline sequences is needed.

SUMMARY OF THE DISCLOSURE

In some embodiments, the present disclosure includes a method that includes an electronic application identifying a downlink testing sequence for execution by a surface control system of a drilling rig; wherein the surface control system of the drilling rig comprises a mud pump system and/or a drive system; wherein the downlink testing sequence includes varying target operating parameters over a predetermined time period; and wherein the varying target operating parameters are target output values of the mud pump system and/or the drive system; instructing, via commands sent from the application to the surface control system, the surface control system to operate in accordance with the downlink testing sequence; during and after instructing the surface control system to operate in accordance with the downlink testing sequence, measuring output values of the mud pump system and/or the drive system over the predetermined time period; the application receiving the measured output values over the predetermined time period; the application calculating differences between the target output values and the measured output values over the predetermined time period; when the differences are within a predetermined level of tolerance, then the application identifies the surface control system as compliant; and when the differences are greater than the predetermined level of tolerance, then the application identifies the surface control system as non-compliant. In some embodiments, the varying target operating parameters comprise alternating first and second target operating parameters. In some embodiments, the first and second target operating parameters alternate after each is maintained for a portion of the predetermined time period. In some embodiments, the first and second target operating parameters are a percentage of an initial output value of the mud pump system and/or the drive system. In some embodiments, the method also includes displaying, on a graphical user interface, a notification that the surface control system is compliant or non-compliant. In some embodiments, the target output values and the measured output values are a mud flow rate. In some embodiments, the target output values and the measured output values are a RPM of the drive system. In some embodiments, the predetermined level of tolerance is a function of the target output values. In some embodiments, the predetermined level of tolerance is a function of the target output values; the application identifies the surface control system as compliant when the differences are within the predetermined level of tolerance for a first period of time; and the application identifies the surface control system as non-compliant when the differences are greater than the predetermined level of tolerance for the first period of time. In some embodiments, the electronic application identifying a downlink sequence for execution by the surface control system; wherein the downlink sequence is configured to provide instructions to a bottom hole assembly (BHA) of the drilling rig; and wherein the BHA includes a rotary steerable system; instructing the mud pump system and/or the drive system to operate in accordance with the downlink sequence; after instructing the mud pump system and/or the drive system to operate in accordance with the downlink sequence, the application receiving data from the BHA; wherein the data received from the BHA is indicative of whether the instructions were received by the BHA; and when the data received from the BHA indicates that the instructions were received by the BHA, then confirming that the downlink was successful.

In some embodiments, the present disclosure includes a drilling apparatus that includes a surface control system of a drilling rig; wherein the surface control system of the drilling rig comprises a mud pump system and/or a drive system; and an electronic application, wherein the electronic application is configured to: identify a downlink testing sequence for execution by the mud pump system and/or the drive system; wherein the downlink testing sequence includes varying target operating parameters over a predetermined time period; and wherein the varying target operating parameters are target output values of the mud pump system and/or the drive system; instruct the surface control system of the drilling rig to operate in accordance with the downlink testing sequence; receive measured output values of the mud pump system and/or the drive system over the predetermined time period; calculate differences between the target output values and the measured output values over the predetermined time period; when the differences are within a predetermined level of tolerance, then the application identifies the surface control system as compliant; and when the differences are greater than the predetermined level of tolerance, then the application identifies the surface control system as non-compliant. In some embodiments, the varying target operating parameters comprise alternating first and second target operating parameters. In some embodiments, the first and second target operating parameters alternate after each is maintained for a portion of the predetermined time period. In some embodiments, the first and second target operating parameters alternate after each is maintained for a portion of the predetermined time period. In some embodiments, the electronic application is further configured to display, on a graphical user interface, a notification that the surface control system is compliant or non-compliant. In some embodiments, the target output values and the measured output values are a mud flow rate. In some embodiments, the target output values and the measured output values are a RPM of the drive system. In some embodiments, the predetermined level of tolerance is a function of the target output values. In some embodiments, the predetermined level of tolerance is a function of the target output values; the application identifies the surface control system as compliant when the differences are within the predetermined level of tolerance for a first period of time; and the application identifies the surface control system as non-compliant when the differences are greater than the predetermined level of tolerance for the first period of time. In some embodiments, the electronic application is further configured to: identify a downlink sequence for execution by the surface control system; wherein the downlink sequence is configured to provide instructions to a bottom hole assembly (BHA) of the drilling rig; and wherein the BHA includes a rotary steerable system; instruct the mud pump system and/or the drive system to operate in accordance with the downlink sequence; after instructing the mud pump system and/or the drive system to operate in accordance with the downlink sequence, the application receives data from the BHA; wherein the data received from the BHA is indicative of whether the instructions were received by the BHA; and when the data received from the BHA indicates that the instructions were received by the BHA, then the application confirms that the downlink was successful.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
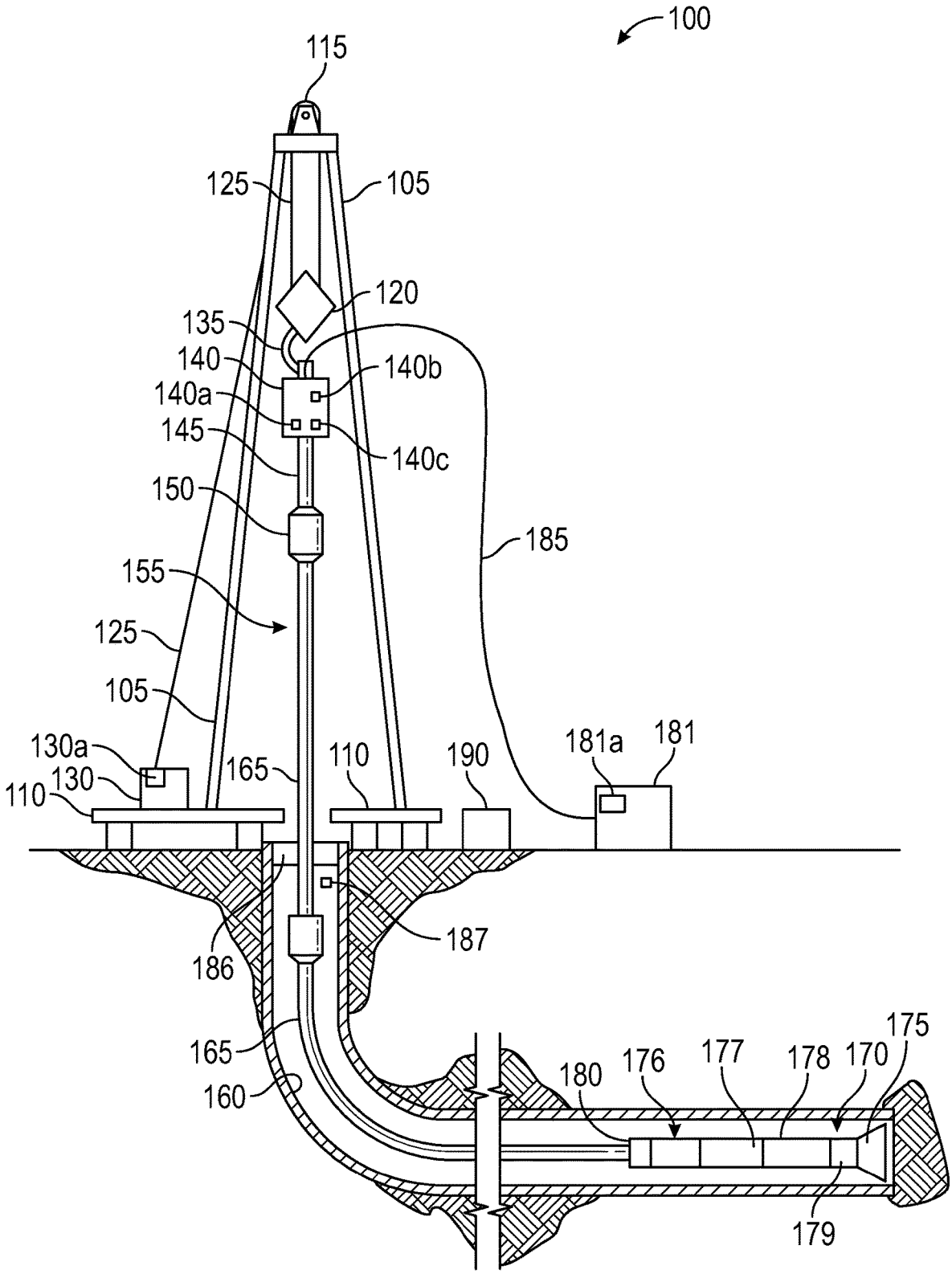
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and method disclosed herein automatically instruct the surface control system to provide target output values in accordance with a downlink sequence, either for the purpose of testing compliance of the system or for the purpose of downlinking instructions during drilling. In addition to automatically instructing the surface control system to provide target output values in accordance with the downlink sequence, the apparatus and method also monitor the output values generated by the surface system and compare those to the target output values to determine whether the surface system can successfully generate the target output values and follow the downlink sequence. Finally, the apparatus and method verify that the instructions sent via the downlink sequence were received and/or implemented. In some embodiment, instructions are downlinked to a rotary steerable system, which includes some type of steering device, such as extendable and retractable arms that apply lateral forces along a borehole wall to gradually effect a turn. In contrast to steerable motors, an RSS permits directional drilling to be conducted while the drill string is rotating. As the drill string rotates, frictional forces are reduced and more bit weight is typically available for drilling.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a surface control system to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A drive system 140 is suspended from the hook 135. A quill 145, extending from the drive system 140, is attached to a saver sub 150, which is attached to a drill string 155 suspended within a wellbore 160. Alternatively, the quill 145 may be attached to the drill string 155 directly. The term "quill" as used herein is not limited to a component which directly extends from the drive system 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill." In the example embodiment depicted in FIG. 1, the drive system 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may additionally or alternatively include a torque sensor 140*a* coupled to or otherwise associated with the drive system 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The drive system 140 may additionally or alternatively include or otherwise be associated with a speed sensor 140*b* configured to detect a value or range of the rotational speed of the quill 145. The drive system 140, the draw works 130, the crown block 115, the traveling block 120, drilling line or dead line anchor may additionally or alternatively include or otherwise be associated with a WOB or hook load sensor 140*c* (e.g., one or more sensors installed somewhere in the load path mechanisms to detect and calculate WOB, which can vary from rig-to-rig). The WOB sensor 140*c* may be configured to detect a WOB value or range, where such detection may be performed at the drive system 140, the draw works 130, or other component of the apparatus 100. Generally, the hook load sensor 140*c* detects the load on the hook 135 as it suspends the drive system 140 and the drill string 155.

The drill string 155 includes interconnected sections of drill pipe or tubulars 165 and a BHA 170, which includes a drill bit 175. The BHA 170 may include one or more measurement-while-drilling ("MWD") or wireline conveyed instruments 176, flexible connections 177, an RSS 178 that includes adjustment mechanisms 179 for push-the-bit drilling or bent housing and bent subs for point-the-bit drilling, a downhole control system 180, stabilizers, and/or drill collars, among other components. One or more pumps of a mud pump system 181 may deliver drilling fluid to the drill string 155 through a hose or other conduit 185, which may be connected to the drive system 140. In some embodiments, a mud pump sensor 181*a* monitors the output of the mud pump system 181 and may measure the flow rate produced by the mud pump system 181 and/or a pressure produced by the mud pump system 181.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the downhole control system 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In some embodiments, the downhole control system 180 is configured to control or assist in the control of one or more components of the apparatus 100. For example, the downhole control system 180 may be configured to transmit operational control signals to the surface control system 190, the draw works 130, the drive system 140, other components of the BHA 170 such as the adjustment mechanism 179, and/or the mud pump system 181. The downhole control system 180 may be a stand-alone component that forms a portion of the BHA 170 or be integrated in the adjustment mechanism 179 or a sensor that forms a portion of the BHA 170. The downhole control system 180 may be configured to transmit the operational control signals or instructions to the draw works 130, the drive system 140, other components of the BHA 170, and/or the mud pump system 181 via wired or wireless transmission means which, for the sake of clarity, are not depicted in FIG. 1.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

Figure 2:
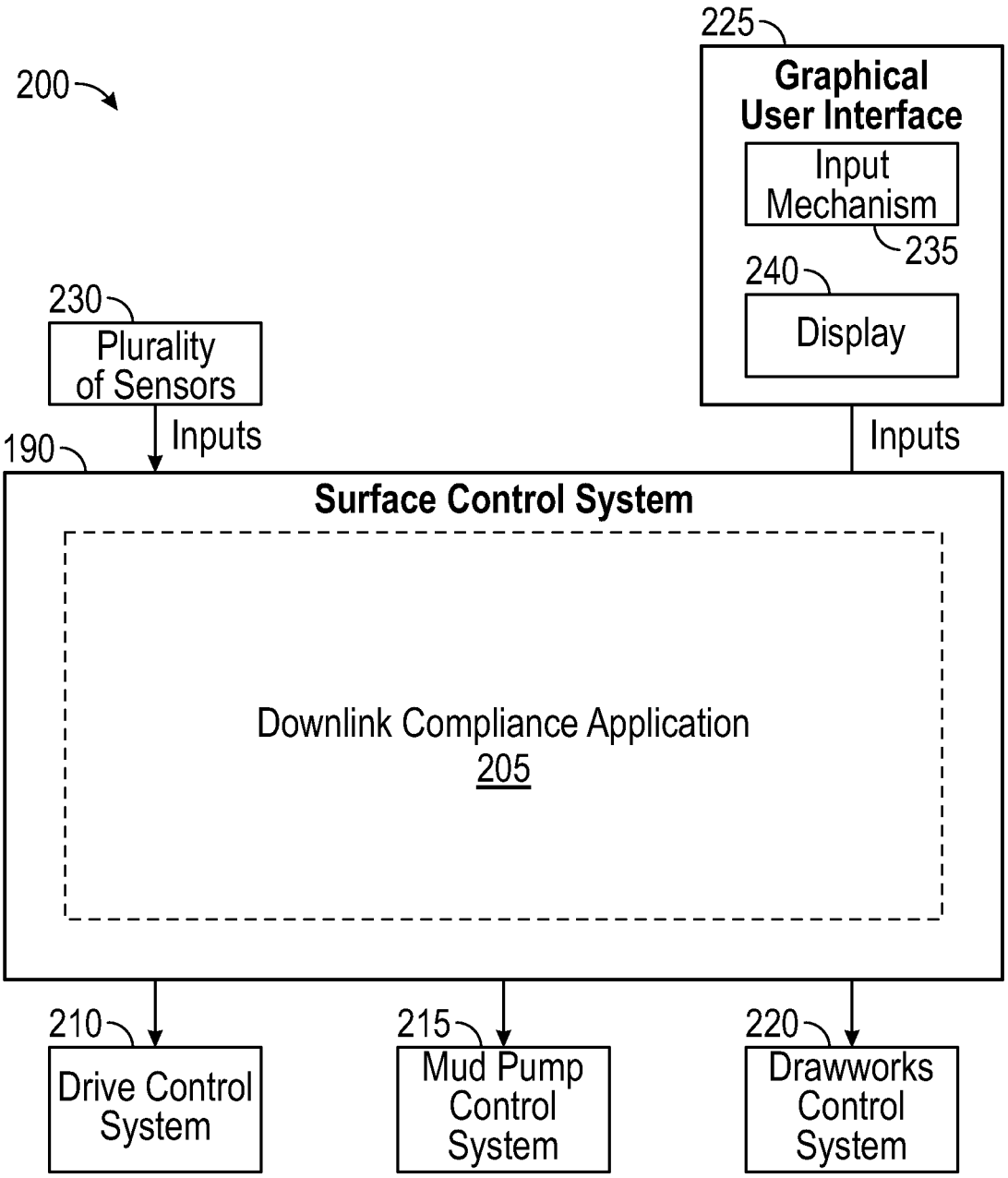
FIG. 2 is a schematic illustration of a portion of the apparatus of FIG. 1, according to one or more aspects of the present disclosure.

FIG. 2 is a diagrammatic illustration of a data flow 200 involving at least a portion of the apparatus 100 according to one embodiment. Generally, the surface control system 190 is operably coupled to or includes a downlink compliance application 205 to control, test, and/or verify a downlinking process. The application 205 sends target outputs to one or more of a drive control system 210, a mud pump control system 215, and a draw works control system 220. The target outputs may be based on a plurality of inputs received via a graphical user interface 225 or via a database lookup. The application 205 can compare the target outputs to a measured output, which is measured using a plurality of sensors 230, and verify that a downlinking was successful after analyzing information received via the plurality of sensors 230.

In some embodiments, the surface control system 190 is, or forms a portion of, a computing system that is configured to control or assist in the control of one or more components of the apparatus 100. For example, the surface control system 190 may be configured to transmit operational control signals to the draw works 130, the drive system 140, the BHA 170 and/or the mud pump system 181. The surface control system 190 may be a stand-alone component installed near the mast 105 and/or other components of the apparatus 100. In an example embodiment, the surface control system 190 includes one or more systems located in a control room proximate the mast 105, such as the general-purpose shelter often referred to as the "doghouse" serving as a combination tool shed, office, communications center, and general meeting place. The surface control system 190 may be configured to transmit the operational control signals to the draw works 130, the drive system 140, the BHA 170, and/or the mud pump system 181 via wired or wireless transmission means.

In some embodiments, the downlink compliance application 205 is an electronic application operably coupled to the drive control system 210, the mud pump control system 215, and the draw works control system 220, and is configured to send signals to each of the control systems 210, 215, and 220 to control the operation of the drive system 140, the mud pump system 181, and the draw works 130. The downlink compliance application 205 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The downlink compliance application 205 may identify which testing sequence or downlink sequence the surface control system 190 should implement and send target output values—based on the selected downlink sequence—to various tools such as the drive control system 210 and/or mud pump control system 215. The identification of the testing sequence or downlink sequence may be in response to receiving a selection by a user via the input mechanism 235 and/or after looking up a plurality of sequences from a database. The downlink compliance application 205 receives data, such as the measured output values, from the plurality of sensors 230. The downlink compliance application 205 may receive the measured output values over a period of time and compare the target output values to the measured output values. The downlink compliance application 205 may determine based on a certain level of tolerance if the surface control system 190 successfully created the target output values and whether a downlink was successful. The downlink compliance application 205 may produce and send the results to the GUI 225. In some embodiments, and as illustrated, the application 205 and the surface control system 190 may be integral components of a single system or surface control system. However, in other embodiments, the application 205 is stored in a component that is physically spaced from the surface control system 190. In this instance, the application 205 may be coupled to or accessed by the surface control system 190 via a wireless network or wired connection.

In some embodiments the drive control system 210 includes the torque sensor 140*a*, the quill position sensor, the hook load sensor 140*c*, the pump pressure sensor, the MSE sensor, and the rotary RPM sensor, and a surface control system and/or other means for controlling the rotational position, speed and direction of the quill or other drill string component coupled to the drive system (such as the quill 145 shown in FIG. 1). The drive control system 210 is configured to receive a drive control signal from the application 205, if not also from other components of the apparatus 100. The drive control signal directs the position (e.g., azimuth), spin direction, spin rate, and/or oscillation of the quill 145. The drive control system 210 is not required to include a top drive, but instead may include other drive systems, such as a power swivel, a rotary table, a coiled tubing unit, a downhole motor, and/or a conventional rotary rig, among others.

In some embodiments, the mud pump control system 215 includes a mud pump surface control system and/or other means for controlling the flow rate and/or pressure of the output of the mud pump system 181 and any associated sensors, such as the sensor 181*a*, for monitoring the output of the mud pump system 181.

In some embodiments, the draw works control system 220 includes the draw works surface control system and/or other means for controlling the feed-out and/or feed-in of the drilling line 125. Such control may include rotational control of the draw works (in v. out) to control the height or position of the hook 135 and may also include control of the rate the hook 135 ascends or descends.

As illustrated, the GUI 225 is operably coupled to or the surface control system 190. The GUI 225 includes an input mechanism 235 for user-inputs. The input mechanism 235 may include a touch-screen, keypad, voice-recognition apparatus, dial, button, switch, slide selector, toggle, joystick, mouse, data base and/or other conventional or future-developed data input device. Such input mechanism 235 may support data input from local and/or remote locations. Alternatively, or additionally, the input mechanism 235 may include means for user-selection of input parameters, such as selecting a specific downlink sequence or selecting a type of tool that forms a portion of the BHA 170, such as via one or more drop-down menus, input windows, etc. In general, the input mechanism 235 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 225 may also include a display 240 for visually presenting information to the user in textual, graphic, or video form. The display 240 may also be utilized by the user to input the input parameters in conjunction with the input mechanism 235. For example, the input mechanism 235 may be integral to or otherwise communicably coupled with the display 240. Depending on the implementation, the display 240 may include, for example, an LED or LCD display computer monitor, touchscreen display, television display, a projector, or other display device. The GUI 225 and the surface control system 190 may be discrete components that are interconnected via wired or wireless means. Alternatively, the GUI 225 and the surface control system 190 may be integral components of a single system or surface control system.

A plurality of sensors 230 provide inputs or data to the surface control system 190 via wired or wireless transmission means. The plurality of sensors 230 may include the ROP sensor 130*a*; the torque sensor 140*a*; the quill speed sensor 140*b*; the hook load sensor 140*c*; the mud pump sensor 181*a*; the surface casing annular pressure sensor 187; a downhole annular pressure sensor; a shock/vibration sensor that is configured for detecting shock and/or vibration in the BHA 170; a toolface sensor configured to estimate or detect the current toolface orientation or toolface angle; a MWD WOB sensor configured to detect WOB at or near the BHA 170; a bit torque sensor that generates data indicative of the torque applied to the bit 175; the hook position sensor; a rotary RPM sensor; a quill position sensor; a pump pressure sensor; a MSE sensor; a bit depth sensor; and any variation thereof. The downhole annular pressure sensor may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on). However, in other embodiments the downhole annular pressure may be calculated using measurements from a plurality of other sensors located downhole or at the surface of the well. The toolface sensor may be or include a conventional or future-developed gravity toolface sensor which detects toolface orientation relative to the Earth's gravitational field. Alternatively, or additionally, the toolface sensor may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor may also, or alternatively, be or include a conventional or future-developed gyro sensor.

The plurality of sensors 230 may additionally or alternatively include an inclination sensor integral to the BHA 170 that is configured to detect inclination at or near the BHA 170. The plurality of sensors 230 may additionally or alternatively include an azimuth sensor integral to the BHA 170 that is configured to detect azimuth at or near the BHA 170. In some embodiments, the BHA 170 also includes another directional sensor (e.g., azimuth, inclination, toolface, combination thereof, etc.) that is spaced along the BHA 170 from a first directional sensor (e.g., the inclination sensor, the azimuth sensor). For example, and in some embodiments, the sensor is positioned in the MWD 176 and the first directional sensor is positioned in the adjustment mechanism 179, with a known distance between them, for example 20 feet, configured to estimate or detect the current toolface orientation or toolface angle. The sensors may be spaced along the BHA 170 in a variety of configurations. The data detected by any of the sensors in the plurality of sensors 230 may be sent via electronic signal to the surface control system 190 via wired or wireless transmission.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

Generally, the surface control system 190: monitors, in real-time, tool settings and drilling operations relating to a wellbore; creates and/or modifies drilling instructions based on the monitored drilling operations; monitors the responsiveness of drilling equipment used in the drilling operation; and identifies potential problems with downlinking operations based on the responsiveness. As used herein, the term "real-time" is thus meant to encompass close to real-time, such as within about 10 seconds, preferably within about 5 seconds, and more preferably within about 2 seconds. "Real-time" can also encompass an amount of time that provides data based on a wellbore drilled to a given depth to provide actionable data according to the present disclosure before a further wellbore being drilled achieves that depth.

Figure 3:
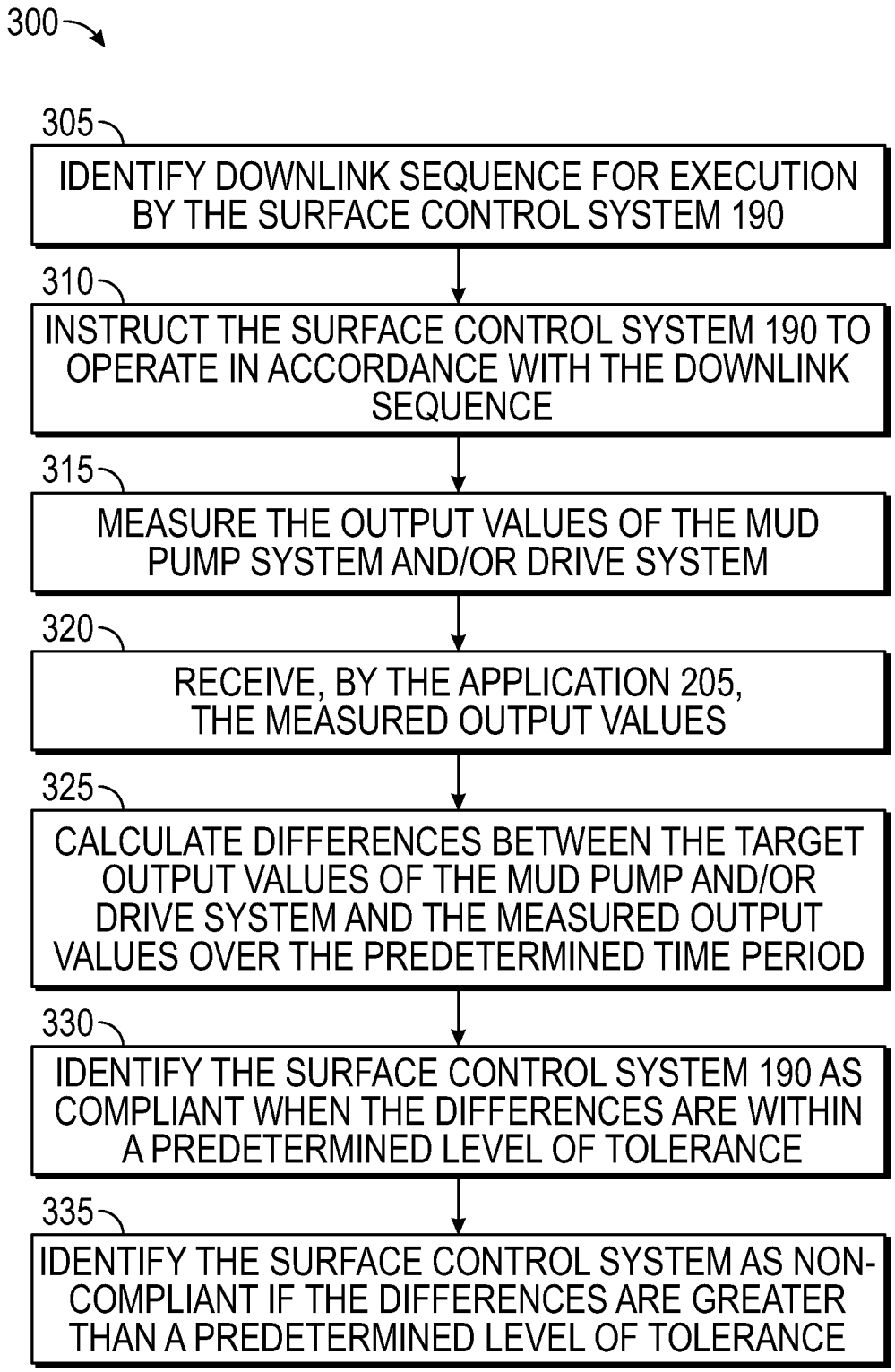
FIG. 3 is a flow chart diagram of a method according to one or more aspects of the present disclosure.

FIG. 3 is a flow chart showing an example method 300 of testing the ability of a surface control system 190 to operate in accordance with a downlink sequence. It is understood that additional steps can be provided before, during, and after the steps of method 300, and that some of the steps described can be replaced or eliminated for other implementations of the method 300. In an example embodiment, the method 300 includes the application 205 identifying a downlink testing sequence for execution by the surface control system 190 at step 305; instructing the surface control system 190 to operate in accordance with the downlink testing sequence at step 310; during and after instructing the surface control system 190 to operate in accordance with the downlink testing sequence, measuring the output values of the mud pump system 181 and/or the drive system 140 at step 315; receiving, by the application 205, the measured output values at step 320; the application 205 calculating differences between the target output values and the measured output values at step 325; and when the differences are within a predetermined level of tolerance, then the application 205 identifies the surface control system 190 as compliant at step 330; and when the differences are greater than the predetermined level of tolerance, then the application 205 identifies the surface control system 190 as non-compliant at step 335.

In some embodiments, the method 300 occurs before rotary drilling begins such that the downlink sequence is a test sequence and no instructions are actually downlinked to the RSS 178.

Figure 4:
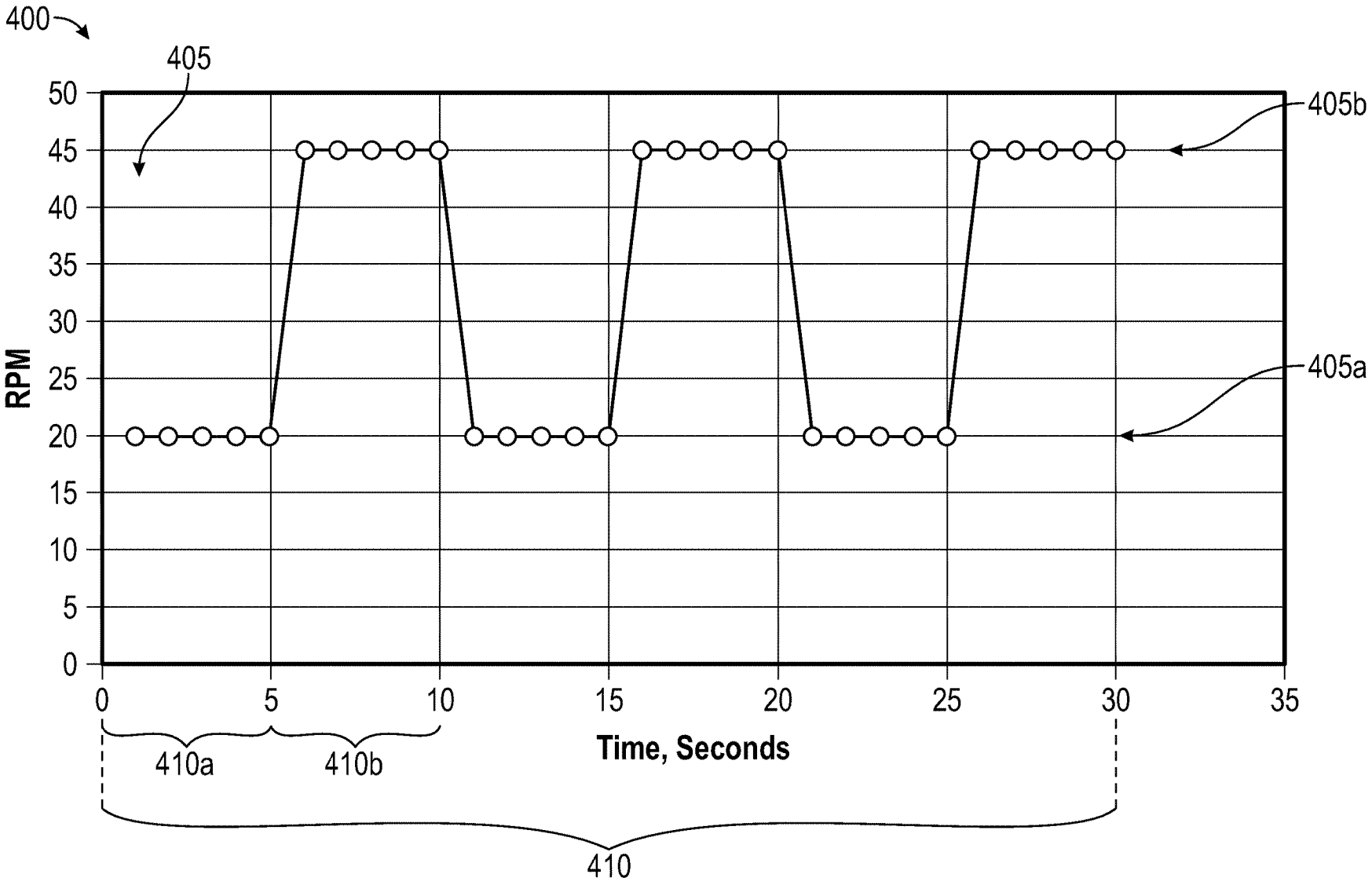
FIG. 4 is graph illustrating a downlink sequence that includes target output values, according to one or more aspects of the present disclosure.

In some embodiments and at the step 305, the downlink compliance application 205 identifies a downlink sequence for execution by the surface control system 190. Generally, a downlink sequence comprises target operating parameters over a predetermined period of time. In certain embodiments, the target operating parameters can be the target output values over a predetermined time period. In some embodiments, the target output values can be the target output values of the mud pump system 181 and/or the drive system 140 over a period of time. FIG. 4 is an example graph depicting a downlink sequence 400. The downlink sequence 400 includes varying target operating parameters 405 over a predetermined time period 410. As illustrated, the varying target operating parameters 405 are varying target output values of the drive system 140. In some embodiments, the varying target operating parameters 405 comprise alternating first 405*a* and second target operating parameters 405*b*. In addition, the varying target operating parameters 405 may alternate after each is maintained for a portion of the predetermined time period 410*a*, 410*b*. As illustrated, the portions 410*a* and 410*b* are equal, but in some embodiments the portions 410*a* and 410 may not be equal. In some embodiments, the first and second target operating parameters 405*a*, 405*b* are a percentage of an initial output value of the mud pump system 181 and/or the drive system 140. As such, the application 205 identifies the downlink sequence after receiving an initial output value of the mud pump system 181 and/or the drive system 140. In some embodiments, the initial output value is the current operating parameters associated with the drilling operation and the target operating parameters are a calculated percentage of that initial output value (including a percentage over 100%). As illustrated, the target output values 405 are the RPM of the drive system 140. The downlink sequence 400, in some embodiments, is one of a plurality of preprogrammed downlink sequences stored in or accessible by the application 205, with the plurality of preprogrammed downlink sequences being the tool manufactures' recommended output values. The downlink sequence 400, in some embodiments, is selected by the user via the GUI 225 or identified by the application 205 after the instructions to be downlinked have been identified by the user or the surface control system 190.

In some embodiments and at step 310, the surface control system 190 is instructed to operate in accordance with the downlink sequence 400. Generally, the application 205 instructs the surface control system 190, via commands, to operate in accordance with the downlink sequence 400. The user or the application 205 can instruct the surface control system 190 to begin to operate.

In some embodiments and at the step 315, the output values are measured over the predetermined time period 410. Generally, the step 320 occurs during and after the step 315. Generally, the output values are measured by the plurality of sensors 230.

Figure 5:
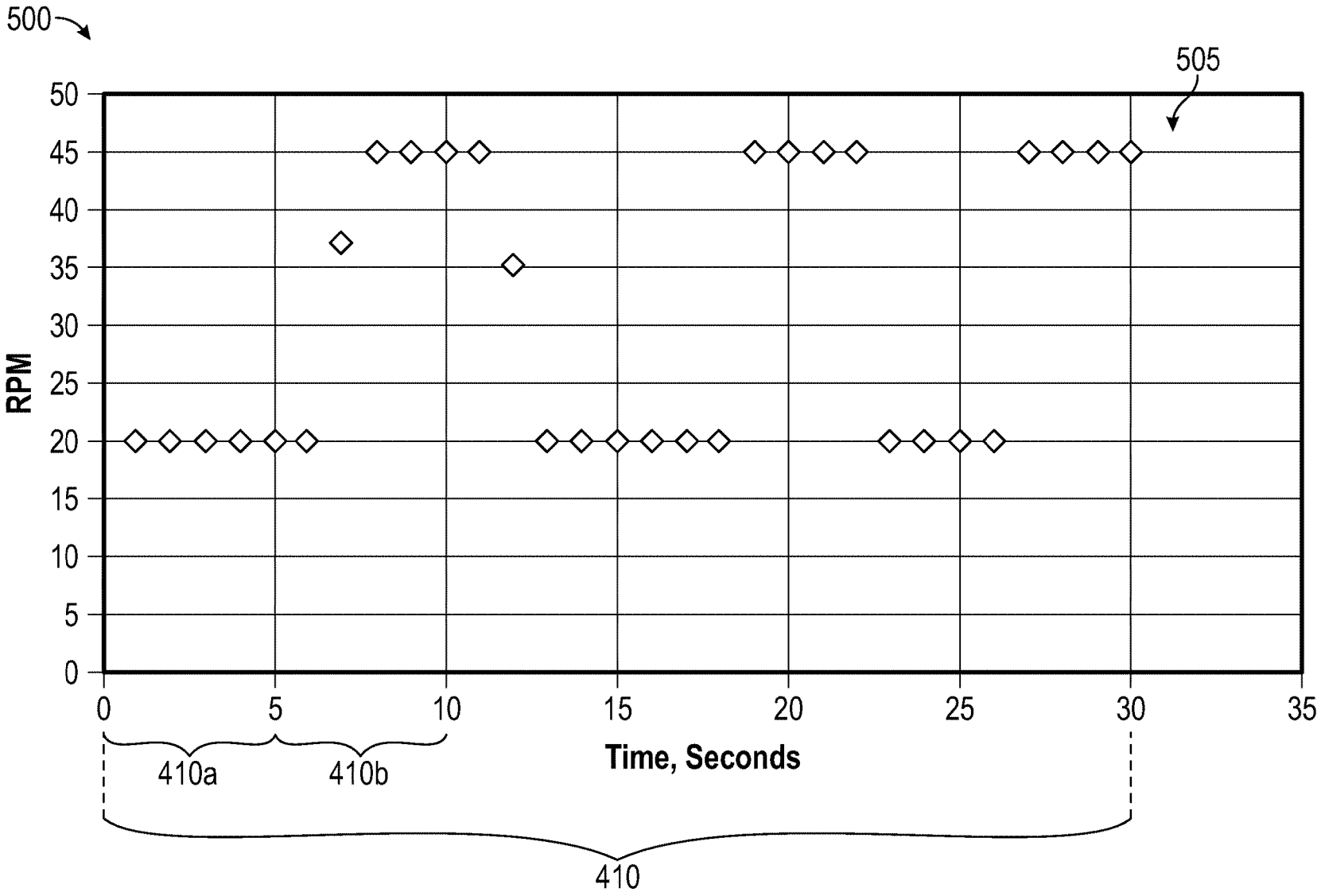
FIG. 5 is graph illustrating a measured output values, according to one or more aspects of the present disclosure.

At step 320, the application 205 receives the measured output values over the predetermined time period 410. The application 205 can receive the measured values directly from any one or more of the plurality of sensors 230 or from the surface control system 190. The measured output values may include be a mud flow rate of a mud pump system 181 at a certain point of time in the predetermined time period 410 and/or a RPM of the drive system 140 at a certain point of time in the predetermined time period 410. FIG. 5 is an example graph depicting measured output values 505 over the predetermined time period 410.

Figure 6:
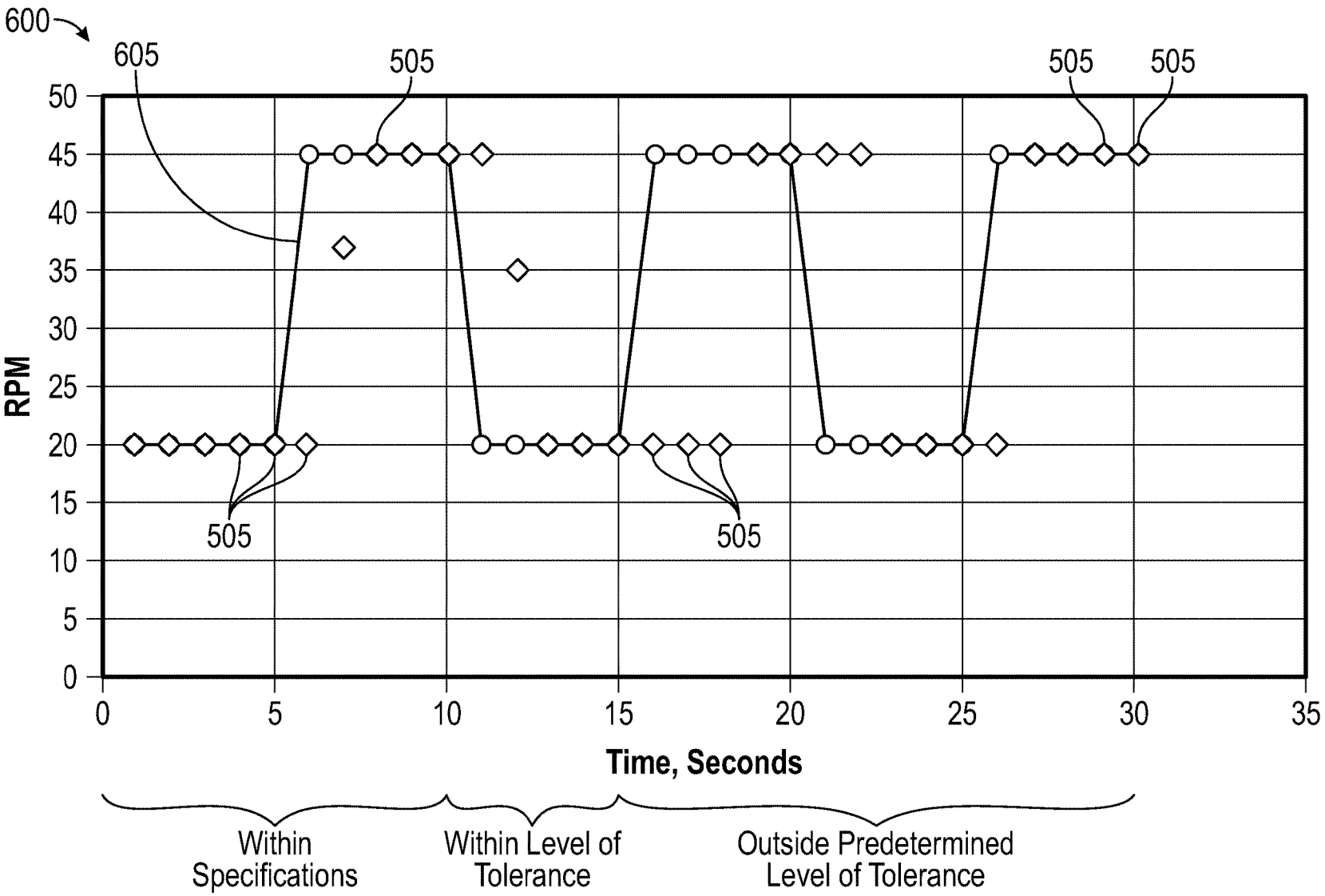
FIG. 6 is graph illustrating the measured output values of FIG. 5 compared to the target output values of FIG. 4, according to one or more aspects of the present disclosure.

At the step 325, the application 205 calculates the difference(s) between the target output values 405 and the measured output values 505 over the predetermined time period 410. FIG. 6 is an example graph illustrating a visual comparison of the target output values 405 against the measured output values 505 over the predetermined time period 410. As illustrated, the application 205 may "grade" the measured output values 505 as being within specification, within a predetermined level of tolerance, or outside of the predetermined level of tolerance. In some embodiments, the measured output values 505 being within the predetermined level of tolerance is associated with the system 190 being in compliance, and the measured output values 505 being outside of the predetermined level of tolerance is associated with the system 190 being out of compliance or non-compliant. The differences may include a difference in target and measured output values, and the predetermined level of tolerance may be +/− percent from the target output values 405. As such, the predetermined level of tolerance is a function of the target output values in some embodiments. For example, the differences may be within the predetermined level of tolerance if the measured output value is +/−10% of the target output value. However, in other embodiments, the predetermined level of tolerance is a numerical value that is a predetermined difference from the target output values 405. For example, the predetermined level of tolerance may be +/−5 RPM when the target output value is an RPM may be +/−5 GPM when the target output value is a GPM. The graph 600 compares the measured output values 505 over the predetermined time period 410 to the target output values 405, which are connected by a line 605, over the predetermined time period 410. In some embodiments, the predetermined level of tolerance is based on the differences over a period of time and/or consecutively received measurements of the output value. For example, the predetermined level of tolerance may be the measured output value being +/−50% of the target output value for two consecutively received measurements or for a time period exceeding two seconds. For example, at approximately 6 seconds within the time period 415, the actual measurement is 20 RPM instead of the target 45 RPM, which is outside of +/−50% of the target output value (i.e., 22.5 RPM). At approximately 7 seconds the actual measurement is 37 RPM instead of the target 45 RPM, which is within the +/−50% of the target output value. Because the actual measurement was within the predetermined level of tolerance, the time period of 0-10 seconds is considered "within specifications." Looking at approximately 15-18 seconds within the time period 415, the actual measurement is 20 RPM instead of the target 45 RPM, which is outside of +/−50% of the target output value (e.g., 22.5 RPM). Because the actual measurement exceeded the predetermined level of tolerance (e.g., exceeded two consecutive measurements being outside of the +/−50% and/or being outside for greater than 2 seconds), the time period of 15-30 seconds is considered "outside predetermined level of tolerance." The application 205 may also grade portions of the actual measurements over the entire time period 415 and use the graded portions to determine whether the surface control system 190 is compliant or non-compliant. For example, the surface control system 190 may still be considered compliant if, during the entire time period 415, the actual measurements were "outside predetermined level of tolerance" fewer than a predetermined number of times.

In some embodiments at step 330, the application 205 identifies the surface control system 190 as compliant when the differences are within the predetermined level of tolerance.

In some embodiments at step 335, the application 205 identifies the surface control system 190 as non-compliant when the differences are greater than the predetermined level of tolerance.

In some embodiments, the method 300 further includes displaying, on the display 235, that the surface control system 190 is compliant or non-compliant. This notification may include a log of results. This method 300 may also include communicating the results of the test to a remote location or user by giving the option to send the results via email or text.

In other embodiments, the method 300 further includes generating graphs similar to FIG. 6 and displaying graphs on the display 235. The application 205 may also produce a log of results relating to the data points of the operating parameters.

While the target output parameters illustrated in FIGS. 4-6 are RPM of the drive system, the target output parameters may be GPM of the mud pump system 181.

In some embodiments, the method 300 occurs prior to putting the BHA 170 downhole. In some embodiments, the method 300 occurs after the BHA 170 is run downhole but prior to drilling. In some embodiments, the method 300 is done prior to every run-in of the BHA 170. In some embodiments, the commands are sent prior to drilling to certify a proper downlink—that the commands and measured values match or are within a certain threshold of the target values.

Figure 7:
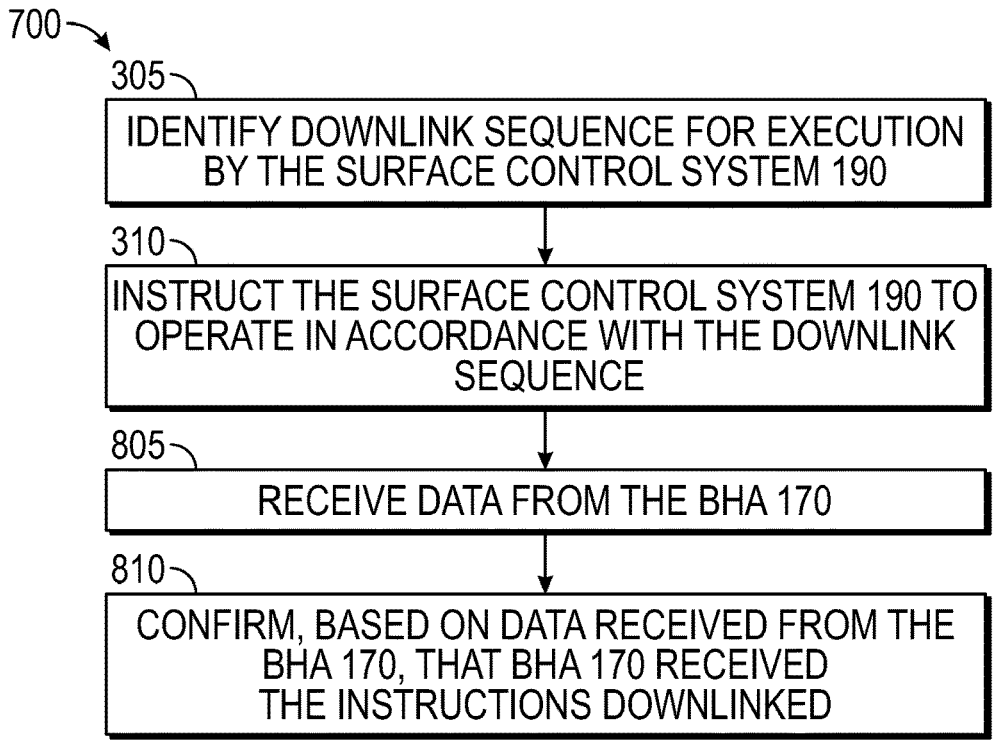
FIG. 7 is a flow chart diagram of a method according to one or more aspects of the present disclosure.

FIG. 7 is a flow chart showing an example method 700 of using the apparatus 100 to downlink instructions and confirm that the instructions were successfully received by the BHA 170. The method 700 includes the steps 305 and 310 of the method 300 and also includes receiving data from the BHA 170 at step 805; and confirming, based on the data received from the BHA 170, that the BHA 170 received the downlinked instructions. It is understood that additional steps can be provided before, during, and after the steps of method 700, and that some of the steps described can be replaced or eliminated for other implementations of the method 700. After the surface control system 190 is found to be compliant at the step 330 of the method 300, instructions may be downlinked to the BHA 170 during drilling.

During the step 305 of the method 700, the downlink sequence is identified based on the instructions to be downlinked to the BHA 170. While the downlink sequence identified in step 305 of the method 300 was to test the capabilities and compliance of the surface control system 190, the downlink sequence identified in step 305 of the method 700 is based on the instructions being sent to the BHA 170 during drilling. The downlink sequence may be identified by the surface control system 190 during the step 305 of the method 700. In some embodiments, the instructions may include instructions to change the setting of a downhole tool from a first configuration to a second configuration.

During the step 310 of the method 700, the surface control system 190 sends signals to the mud pump system and/or the drive system so that the mud pump system and/or the drive system operates in accordance with the target output values of the selected downlink sequence. Generally, the step 310 requires that commands are sent from the surface control system 190 to the drive control system 210 and the mud pump control system 215 to operate in accordance with selected downlink sequence. In some embodiments, the application 205 instructs the surface control system 190 to send signals to the mud pump system and/or the drive system.

At step 805, the surface control system 190 receives data from the BHA 170. The data received from the BHA 170 includes data indicative of whether the instructions were implemented. For example, the data received from the BHA 170 may indicate whether the tool setting was changed from the first configuration to the second configuration.

At the step 810, the application 205 confirms, based on the data received from the BHA 170, that the BHA 170 received the instructions downlinked. That is, the application 205 certifies that the downlink occurred.

In some embodiments, the application 205 confirms, based on the data received from the BHA 170, that the BHA 170 did not receive the instructions downlinked. That is, the application 205 notes that the downlinking sequence failed.

In some embodiments, the method 700 also includes generating graphs, logs, and pass/fail reports of the downlinking sequences and success/failures of each.

In some embodiments, the method 700 also includes generating an alert or confirmation that the downlink occurred. In some embodiments, the application 205 causes a user to receive a confirmation that the rotary steerable system has received the commands. In some embodiments, the alerts or confirmation include the graphs, logs, and pass/fail reports of the downlinking sequences. This notification may include a log of results, charts, graphs, or other ways to display actual output values over a predetermined time compared to ideal output values over a predetermined time. This notification may also include a means to communicate the results of the test to a remote location or user by giving the option to send the results via email or text. This notification may also be an audio alert.

In some embodiments and using the method 300, before starting operations with a rotary steerable, the surface control system 190 is downlink certified, which ensures that while drilling ahead no miscommunications with the downhole tool are going to occur because of limitations or issues on the control system side.

In some embodiments, the downlink sequence selected in the method 300 is a downlink sequence that is capable of transmitting instructions to the BHA 170, but does not because rotary drilling using the RSS 178 is not occurring. As such, the downlink sequence of the method 300 is considered a downlink testing sequence.

Figure 8:
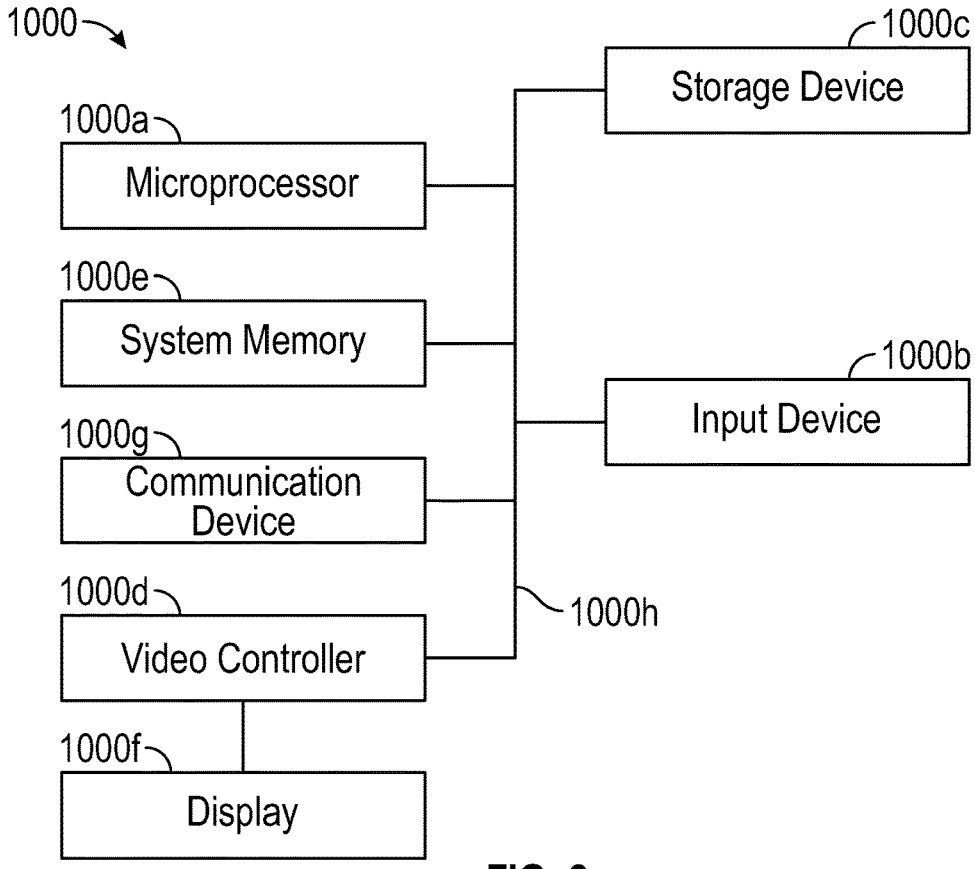
FIG. 8 is a diagrammatic illustration of a node for implementing one or more example embodiments of the present disclosure, according to an example embodiment.

In an example embodiment, as illustrated in FIG. 8 with continuing reference to FIGS. 1-7, an illustrative node 1000 for implementing one or more of the example embodiments described above and/or illustrated in FIGS. 1-7 is depicted. The illustrative node 1000 includes a microprocessor 1000*a*, an input device 1000*b*, a storage device 1000*c*, a video surface control system 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1-7 include at least the illustrative node 1000 and/or components thereof, and/or one or more nodes that are substantially similar to the illustrative node 1000 and/or components thereof. In several example embodiments, one or more of the above-described components of the illustrative node 1000, the system 10, and/or the example embodiments described above and/or illustrated in FIGS. 1-7 include respective pluralities of same components.

In several example embodiments, one or more of the applications, systems, and application programs described above and/or illustrated in FIGS. 1-8 include a computer program that includes a plurality of instructions, data, and/or any combination thereof; an application written in, for example, Arena, Hypertext Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof.

In several example embodiments, a computer system typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random-access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a non-transitory computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A, B, or C; A and B, B and C, or A and C; or all three of A, B, and C."

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method comprising:

an electronic application identifying a downlink testing sequence for execution by a surface control system of a drilling rig;

wherein the surface control system of the drilling rig comprises a mud pump system and/or a drive system;

wherein the downlink testing sequence includes varying target operating parameters over a predetermined time period; and wherein the varying target operating parameters are target output values of the mud pump system and/or the drive system;

instructing, via commands sent from the application to the surface control system, the surface control system to operate in accordance with the downlink testing sequence;

during and after instructing the surface control system to operate in accordance with the downlink testing sequence, measuring output values of the mud pump system and/or the drive system over the predetermined time period;

the application receiving the measured output values over the predetermined time period;

the application calculating differences between the target output values and the measured output values over the predetermined time period;

when the differences are within a predetermined level of tolerance, then the application identifies the surface control system as compliant;

when the differences are greater than the predetermined level of tolerance, then the application identifies the surface control system as non-compliant;

displaying, on a graphical user interface, a notification that the surface control system is compliant or non-compliant.

2. The method of claim 1, wherein the varying target operating parameters comprise alternating first and second target operating parameters.

3. The method of claim 2, wherein the first and second target operating parameters alternate after each is maintained for a portion of the predetermined time period.

4. The method of claim 3, wherein the first and second target operating parameters are a percentage of an initial output value of the mud pump system and/or the drive system.

5. The method of claim 2, wherein instructing, via commands sent from the application to the surface control system, the surface control system to operate in accordance with the downlink testing sequence comprises instructing the surface control system to automatically alternate between the first and second target operating parameters.

6. The method of claim 1, wherein the target output values and the measured output values are a mud flow rate.

7. The method of claim 1, wherein the target output values and the measured output values are a RPM of the drive system.

8. The method of claim 1, wherein the predetermined level of tolerance is a function of the target output values.

9. The method of claim 1, wherein the predetermined level of tolerance is a function of the target output values;

wherein the application identifies the surface control system as compliant when the differences are within the predetermined level of tolerance for a first period of time; and wherein the application identifies the surface control system as non-compliant when the differences are greater than the predetermined level of tolerance for the first period of time.

10. The method of claim 1, the electronic application identifying a downlink sequence for execution by the surface control system;

wherein the downlink sequence is configured to provide instructions to a bottom hole assembly (BHA) of the drilling rig; and wherein the BHA includes a rotary steerable system;

instructing the mud pump system and/or the drive system to operate in accordance with the downlink sequence;

after instructing the mud pump system and/or the drive system to operate in accordance with the downlink sequence, the application receiving data from the BHA;

wherein the data received from the BHA is indicative of whether the instructions were received by the BHA; and when the data received from the BHA indicates that the instructions were received by the BHA, then confirming that the downlink was successful.

11. A drilling apparatus comprising:

a surface control system of a drilling rig; wherein the surface control system of the drilling rig comprises a mud pump system and/or a drive system; and an electronic application, wherein the electronic application is configured to:

identify a downlink testing sequence for execution by the mud pump system and/or the drive system;

wherein the downlink testing sequence includes varying target operating parameters over a predetermined time period; and wherein the varying target operating parameters are target output values of the mud pump system and/or the drive system;

instruct the surface control system of the drilling rig to operate in accordance with the downlink testing sequence;

receive measured output values of the mud pump system and/or the drive system over the predetermined time period;

calculate differences between the target output values and the measured output values over the predetermined time period;

when the differences are within a predetermined level of tolerance, then identify the surface control system as compliant; and when the differences are greater than the predetermined level of tolerance, then identify the surface control system as non-compliant.

12. The apparatus of claim 11, wherein the varying target operating parameters comprise alternating first and second target operating parameters.

13. The apparatus of claim 12, wherein the first and second target operating parameters alternate after each is maintained for a portion of the predetermined time period.

14. The apparatus of claim 13, wherein the first and second target operating parameters alternate after each is maintained for a portion of the predetermined time period.

15. The apparatus of claim 11, wherein the electronic application is further configured to display, on a graphical user interface, a notification that the surface control system is compliant or non-compliant.

16. The apparatus of claim 11, wherein the target output values and the measured output values are a mud flow rate.

17. The apparatus of claim 11, wherein the target output values and the measured output values are a RPM of the drive system.

18. The apparatus of claim 11, wherein the predetermined level of tolerance is a function of the target output values.

19. The apparatus of claim 11, wherein the predetermined level of tolerance is a function of the target output values;

wherein the application identifies the surface control system as compliant when the differences are within the predetermined level of tolerance for a first period of time; and wherein the application identifies the surface control system as non-compliant when the differences are greater than the predetermined level of tolerance for the first period of time.

20. The apparatus of claim 11, wherein the electronic application is further configured to:

identify a downlink sequence for execution by the surface control system;

wherein the downlink sequence is configured to provide instructions to a bottom hole assembly (BHA) of the drilling rig; and wherein the BHA includes a rotary steerable system;

instruct the mud pump system and/or the drive system to operate in accordance with the downlink sequence;

receive data from the BHA after instructing the mud pump system and/or the drive system to operate in accordance with the downlink sequence;

wherein the data received from the BHA is indicative of whether the instructions were received by the BHA; and confirms that the downlink was successful when the data received from the BHA indicates that the instructions were received by the BHA.

* * * * *